US005411240A

United States Patent [19]

Rapp et al.

[11] Patent Number: 5,411,240

[45] Date of Patent: May 2, 1995

[54] FURNACE FOR DELIVERING A MELT TO A CASTING MACHINE

[75] Inventors: Josef Rapp, Traunkirchen; Erich Rauch, Gmunden, both of Austria

[73] Assignee: Ing. Rauch Fertigungstechnik Gesellschaft m.b.H., Gmunden, Austria

[21] Appl. No.: 185,473

[22] Filed: Jan. 24, 1994

[30] Foreign Application Priority Data

Jan. 26, 1993 [AT] Austria ..... 115/93

[51] Int. Cl.[6] ..... C21B 13/14

[52] U.S. Cl. ..... 266/94; 164/337; 222/594

[58] Field of Search ..... 164/335, 337; 266/94, 266/166, 207, 236; 222/594

[56] References Cited

FOREIGN PATENT DOCUMENTS 1136452 9/1962 Germany .
1508560 12/1969 Germany .
4123855 4/1992 Japan ..... 164/337

*Primary Examiner*—Melvyn J. Andrews
*Attorney, Agent, or Firm*—Collard & Roe

[57] ABSTRACT

A two-chamber furnace for delivering a melt to a casting machine comprises a storage chamber having an inlet device for material to be melted, a removal chamber having an outlet device for removing the melted material, and an intermediate chamber arranged between the storage chamber and the removal chamber, the intermediate chamber communicating with the removal chamber through a balancing port and with the storage chamber by an overflow. A control device controls the level of the melted material in the removal chamber, the control device including a pump for moving the melted material from the storage chamber to the intermediate chamber.

2 Claims, 1 Drawing Sheet

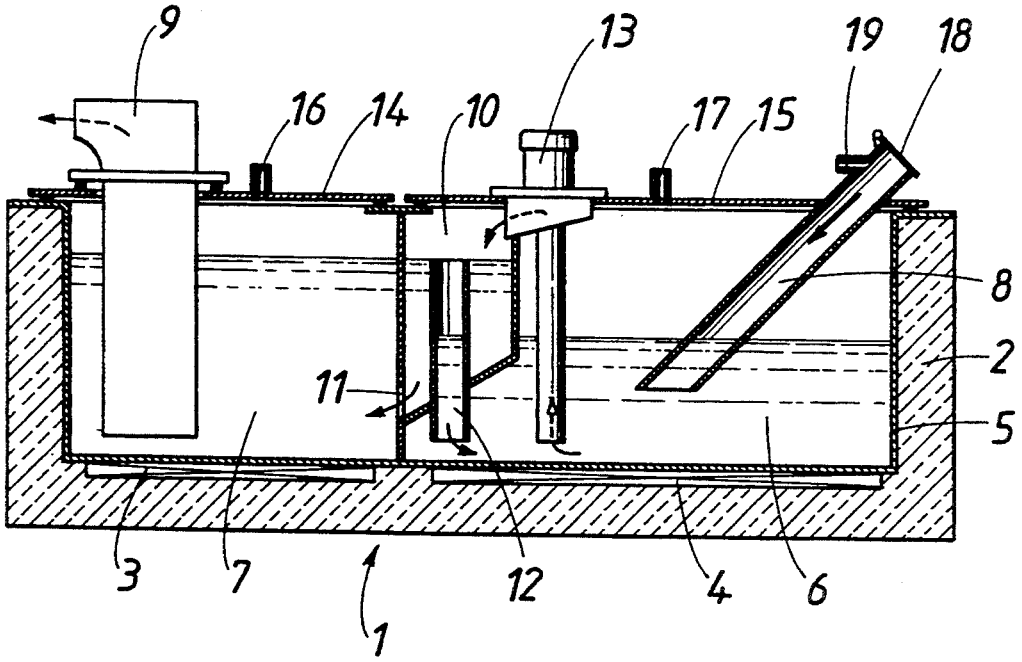
9
13
19
18
16
14
10
17
15
8
2
11
5
3
7
12
4
6
1

FURNACE FOR DELIVERING A MELT TO A CASTING MACHINE

BACKGROUND OF THE INVENTION

1. Field of the Invention

The present invention relates to a two-chamber furnace for delivering a melt to a casting machine, which comprises a storage chamber having an inlet device for material to be melted and a removal chamber having an outlet device for removing the melted material. A control device controls the level of the melted material in the removal chamber, the control device including a pump for moving the melted material from the storage chamber to the removal chamber.

2. Description of the Prior Art

Such two-chamber melt furnace have been found very useful because the storage chamber may be used to process the material separately from the chamber from which the processed material is removed. Therefore, the amount of molten metal delivered from the removal chamber to the casting machine may be replaced constantly by a melt ready for casting, which avoids variations in the melt removal conditions decisive for the quality of the product. However, in the known two-chamber furnaces of this type, the melt is maintained at a steady level in the removal chamber by pumping the melt directly from the storage chamber into the removal chamber under the control of melt level sensors. In some cases, an overflow is provided to prevent the filling of the removal chamber with an excessive amount of melt. Such a melt level control device is relatively complicated and expensive. It also causes turbulence in the melt bath in the removal chamber because of the inflow of melt from the storage chamber and, furthermore, the atmospheres of the two chambers are in communication, which unavoidably causes undesirable oxidation phenomena in the melt because of the entry of air with the material being delivered to the furnace.

SUMMARY OF THE INVENTION

It is the primary object of this invention to overcome these disadvantages and to provide a two-chamber melting furnace of the first-described type which may be operated more rationally and with enhanced effectiveness.

The above and other objects are accomplished according to the invention with a two-chamber furnace for delivering a melt to a casting machine, which comprises a storage chamber having an inlet device for material to be melted, a removal chamber having an outlet device for removing the melted material, and an intermediate chamber arranged between the storage chamber and the removal chamber, the intermediate chamber communicating with the removal chamber through a balancing port and with the storage chamber by an overflow. A control device for controlling the level of the melted material in the removal chamber includes a pump for moving the melted material from the storage chamber to the intermediate chamber.

The intermediate chamber forms a sluice between the storage chamber and the removal chamber, permitting a total separation between these two furnace chambers. Since the melt for filling up the removal chamber is not delivered directly to the removal chamber as melt is removed therefrom for delivery to the casting machine and the intermediate chamber in communication with the storage chamber forms a container therewith, the removal chamber may be filled up with the melt through the melt level balancing port without causing undesirable turbulence in the melt bath. Furthermore, the overflow between the intermediate and storage chambers enables the melt in the removal chamber to be maintained at an exact level controlled by the overflow level by suitably overdosing the amount of the melt delivered. This is accomplished automatically without the need for complicated controls and level sensors.

According to a preferred embodiment, the furnace further comprises gas-tight closure means for the storage, intermediate and removal chambers, and gas inlet conduits leading into the gas-tight chambers for delivering a protective gas into the chambers. Creating a protective gas atmosphere in the furnace chambers prevents the danger of oxidation in a very simple manner because, on the one hand, the removal chamber, which is completely separated from the other chambers, can be securely shut off from any undesirable entry of air and can be provided with a protective gas atmosphere while, on the other hand, the same can be done for the other gas-tight furnace chambers. If the inlet device for delivering the material to be melted is also gas-tight and, preferably, has its own protective gas scavenging device, the protective gas atmosphere remains intact during the material delivery to the furnace.

BRIEF DESCRIPTION OF THE DRAWING

The above and other objects, advantages and features of the invention will become more apparent from the following detailed description of a now preferred embodiment of the two-chamber furnace, taken in conjunction with the accompanying single figure schematically showing the furnace in cross section.

DETAILED DESCRIPTION OF THE PREFERRED EMBODIMENT

Referring now to the drawing, there is shown a two-chamber furnace 1 for delivering a melt to a casting machine (not illustrated). The furnace comprises refractory housing 2 and heating devices 3, 4 underneath furnace insert 5 which defines storage chamber 6 and removal chamber 7. Storage chamber 6 has tubular inlet device 8 for material to be melted, and removal chamber 7 has outlet device 9 for removing the melted material and delivering the melt to a casting machine (not shown).

According to the present invention, intermediate chamber 10 is arranged between storage chamber 6 and removal chamber 7, and the intermediate chamber communicates with the removal chamber through balancing port 11 and with the storage chamber by overflow pipe 12. A control device for controlling the level of the melted material in removal chamber 7 includes pump 13 for moving the melted material from storage chamber 4 to intermediate chamber 10. When required by the removal of melt from removal chamber 7 through outlet device 9, pump 13 delivers the melt processed in storage chamber 4 to intermediate chamber 10 whence it flows through port 11 to compensate for the lowering of the melt level in the removal chamber. A preferred pump has been described and claimed in our copending U.S. patent application Ser. No. 08/185,475, filed simultaneously under the title "Worm Pump for Delivering a Metal Melt".

The illustrated two-chamber furnace further comprises gas-tight closures 14 and 15 for the storage, intermediate and removal chambers, and gas inlet conduits 16, 17 leading into the gas-tight chambers 6, 7 for delivering a protective gas into the chambers. To avoid contamination of this protective atmosphere in the furnace chambers by the delivery of the material to be melted into storage chamber 6, inlet pipe 8 also has a gas-tight closure 18 and may be scavenged with a protective gas through inlet conduit 19.

The two-chamber furnace is operated in the following manner:

The material to be cast is delivered through inlet device 8 into storage chamber 6 where it is melted and kept hot, and this melt is delivered to removal chamber 7 in a condition ready for casting. The melt flows from the storage chamber to the removal chamber through intermediate chamber 10, which assures a complete separation between storage chamber 6 and removal chamber 7. Therefore, the material may be processed in the storage chamber without in any way disturbing the removal of the melt from the separated removal chamber. The level of the melt in removal chamber 7 is controlled by pump 13 which delivers the melt from storage chamber 6 to intermediate chamber 10, and the melt automatically flows through port 11 into removal chamber 7 to maintain the level of the melt constant without creating undesirable turbulences in the melt bath in the removal chamber. Overflow 12 permits the melt level to be determined in a simple manner by suitably overfilling intermediate chamber 10, any excess amount of melt overflowing back from the intermediate chamber into storage chamber 6. Therefore, if the pump operation and the amount of melt delivered by the pump is adjusted according to the amount of melt required by the casting machine, no level sensors are required to obtain an exact level of the melt in removal chamber 7.

What is claimed is:

1. A furnace for delivering a melt to a casting machine, which comprises (a) a storage chamber having an inlet device for material to be melted, (b) a removal chamber having an outlet device for removing the melted material, (c) an intermediate chamber arranged between the storage chamber and the removal chamber, (1) the intermediate chamber communicating with the removal chamber through a balancing port and with the storage chamber by an overflow, and (d) a control device for controlling the level of the melted material in the removal chamber, the control device including (1) a pump for moving the melted material from the storage chamber to the intermediate chamber.

2. The furnace of claim 1, further comprising gas-tight closure means for the storage, intermediate and removal chambers, and gas inlet conduits leading into the gas-tight chambers for delivering a protective gas into the chambers.

* * * * *